United States Patent [19]

Nims

[11] 4,082,118

[45] Apr. 4, 1978

[54] PNEUMATIC PICKING MECHANISM FOR LOOMS

[75] Inventor: Philip A. Nims, Auburn, Mass.

[73] Assignee: Crompton & Knowles Corporation, New York, N.Y.

[21] Appl. No.: 800,488

[22] Filed: May 25, 1977

Related U.S. Application Data

[63] Continuation-in-part of Ser. No. 734,144, Oct. 20, 1976, abandoned.

[51] Int. Cl.[2] ..... D03D 49/26

[52] U.S. Cl. ..... 139/144; 139/438

[58] Field of Search ..... 139/142, 144, 437, 438, 139/439; 60/477, 478, 341 R; 91/400, 401, 402, 403, 404, 405; 173/135, 136, 137

[56] References Cited

U.S. PATENT DOCUMENTS

| | | | |
|---|---|---|---|
| 2,923,344 | 2/1960 | La Voie et al. | 91/341 R |
| 3,299,968 | 1/1967 | Cunningham | 91/341 R |
| 3,330,305 | 7/1967 | Suaty et al. | 139/438 |
| 3,410,180 | 11/1968 | Spangler et al. | 91/404 |
| 3,416,572 | 12/1968 | Giavini | 139/438 |
| 3,722,552 | 3/1973 | Indra et al. | 139/144 |
| 3,875,974 | 4/1975 | Rambousek | 139/144 |

*Primary Examiner*—Henry S. Jaudon
*Attorney, Agent, or Firm*—Howard G. Garner

[57] ABSTRACT

Improvement in pneumatic shuttle picking mechanism for looms which include a picking cylinder and a pump cylinder; a first piston slidably mounted within the picking cylinder and having attached thereto a piston rod which extends through the outlet end of the picking cylinder for picking engagement with the shuttle; a second piston slidably mounted within the pump cylinder and having attached thereto a piston rod which extends out of the inlet end of the pump cylinder for attachment to drive mechanism for reciprocating the second piston; conduits connecting the outlet side of the pump cylinder to the inlet side of the picking cylinder and the outlet side of the picking cylinder to the inlet side of the pump cylinder in a closed system; and a one-way valve located at one end of the pump cylinder which only allows air to enter the pump cylinder from the atmosphere and only when the pressure within the pump cylinder falls below atmospheric pressure.

4 Claims, 5 Drawing Figures

PNEUMATIC PICKING MECHANISM FOR LOOMS

This application is a continuation-in-part of Application Ser. No. 734,144 filed Oct. 20, 1976 now abandoned.

BACKGROUND OF THE INVENTION

The present invention relates to improvements in picking mechanism for looms, particularly looms of the type which utilize a shuttle box which is rotated 180° before and after each pick such as that illustrated in U.S. Pat. Nos. to V. Svaty 3,315,709 dated Apr. 25, 1967 and 3,330,305 dated July 11, 1967.

Pneumatic picking mechanisms for which the present invention is an improvement generally comprise a picking cylinder and a pump cylinder which are interconnected in a closed pneumatic system. A picking piston is slidable within the picking cylinder and has a picking piston rod which is attached to the picking piston and which extends beyond the picking cylinder for a picking engagement with the shuttle. A pump piston is slidable within the pump cylinder and has attached thereto a pump piston rod which extends beyond the inlet end of the pump cylinder. Mechanical drive means are connected to the extending portion of the pump piston rod for reciprocating the pump piston within the pump cylinder. Conduits connect the inlet end of the picking cylinder to the outlet end of the pump cylinder and the outlet end of the picking cylinder to the inlet end of the pump cylinder in a closed system so that during the power stroke of the pump piston from the inlet to the outlet end of the pump cylinder, air is pumped from the outlet end of the pump cylinder to the inlet end of the picking cylinder thereby driving the picking piston from the inlet end to the outlet end of the picking cylinder in a picking stroke. The extending portion of the picking piston rod engages a shuttle and propels it through the shed to the opposite side of the loom. During this picking stroke, air is forced from the outlet end of the picking cylinder into the inlet end of the pump cylinder thereby assisting the pump piston in its power stroke.

The advantages of a closed pneumatic system such as described above is that much less power is required to reciprocate the pump piston within the pump cylinder. However, certain pressures must be maintained in the picking and pump cylinders during certain phases of each picking cycle. Because of many factors such as heat and loss of air through various seals in the system, the pressures have a tendency to vary from the ideal during certain phases of each cycle. In order to eliminate this problem, it has been common practice to employ bleeder valves at one or both ends of the pump cylinder. These valves are normally closed and are effective when opened to allow air to enter the cylinder when the pressure in the cylinder is less than atmospheric and to allow air to exit from the cylinder if the pressure within the cylinder is greater than atmospheric. Mechanical means are employed to open each bleeder valve at a point during each picking cycle. This occurs at a point in the cycle where the pressure in the portion of the cylinder that is adjacent the bleeder valve is atmospheric when the cylinder is operating under ideal pressures. When the pressures stray from the ideal, the pressure within the portion of the cylinder which is adjacent the bleeder valve will either be above or below atmospheric at the point in the cycle where the valve is opened. At this point, air will be either expelled or taken into the cylinder so that the operating pressures will return to the ideal state. In this way, the system is self correcting during normal operation of the loom.

A problem arises in the above picking systems when the loom is shut down for an extended period of time, as for example, between shifts, or a changing of a warp, or for any other reason. During an extended period of shut down of the loom, a substantial portion of the air may be lost from the picking and pump cylinders thru the various seals throughout the system. When the loom is started, there may not be enough air pressure in the inlet end of the pump cylinder during the return stroke of the pump piston to cause the picking piston to achieve a full return stroke. This means that the picking piston rod will remain outside of the picking cylinder at least to some degree. During the picking stroke of the picking cylinder, the shuttle will not be given a full picking stroke and will either not pass completely through the warp shed or will box improperly on the other side of the loom. In addition, the portion of the picking piston rod which extends from the piston picking cylinder is likely to be damaged by moving parts associated with picking expecially in picking of gripper shuttle looms such as that disclosed in the above-identified U.S. patents which employ a rotatable shuttle box. As the shuttle box is rotated 180°, it will strike and damage the extending portion of the picking piston rod. Since the bleeder valves can only be opened for a very short portion of each picking cycle they are not effective to draw in enough air to bring the system back to an ideal pressure situation. If a substantial amount of air is lost during the shut-down period, it may take several picks before the cylinder pressures reach their ideal operating state. During this time, faulty picking will occur and damage will occur to various picking components.

SUMMARY OF THE INVENTION

It is the principle object of the present invention to provide a pneumatic picking system in which one-way valves are located at one or both ends of the pump cylinder. These valves are the type which allow air to enter the cylinder but do not allow air to escape from the cylinder to the atmosphere. In addition, each one-way valve is effective to allow air to enter from the atmosphere into the portion of the cylinder which is adjacent the one-way valve only if the air pressure within that portion of the cylinder is below atmospheric. Since the one-way valve only allows air to enter the cylinder, it can operate over a substantial portion of the picking cycle. If there has been considerable air flow resulting in substantial reduction in pressure within the pump cylinder, air will be below atmospheric pressure at the inlet end of the cylinder during a substantial portion of the power stroke and the one-way valve will allow air to enter from the atmosphere during this entire portion. Because of this, the air pressure in the pump cylinder will correct itself during this single power stroke so that on its return stroke there will be sufficient pressure to push the picking piston all the way back to the inlet end of the picking cylinder. This will avoid damage to the picking cylinder rod. It is preferred to employ a one-way valve at each end of the pump cylinder to bring the entire system to the ideal pressures as quickly as possible. However, when the invention is applied to the type of loom in which the shuttle box is rotated 180° before and after each pick, it is imperative that the one-way valve be applied at the inlet end of the pump cylinder. This will insure that there is sufficient pressure in the inlet end of the pump cylinder to force the picking piston all the way back to the inlet end of the picking cylinder and avoid damage.

BRIEF DESCRIPTION OF THE DRAWINGS

The invention will be more readily understood from the following specification when read in conjunction with the accompanying drawings in which.

DETAILED DESCRIPTION

Figure 1:
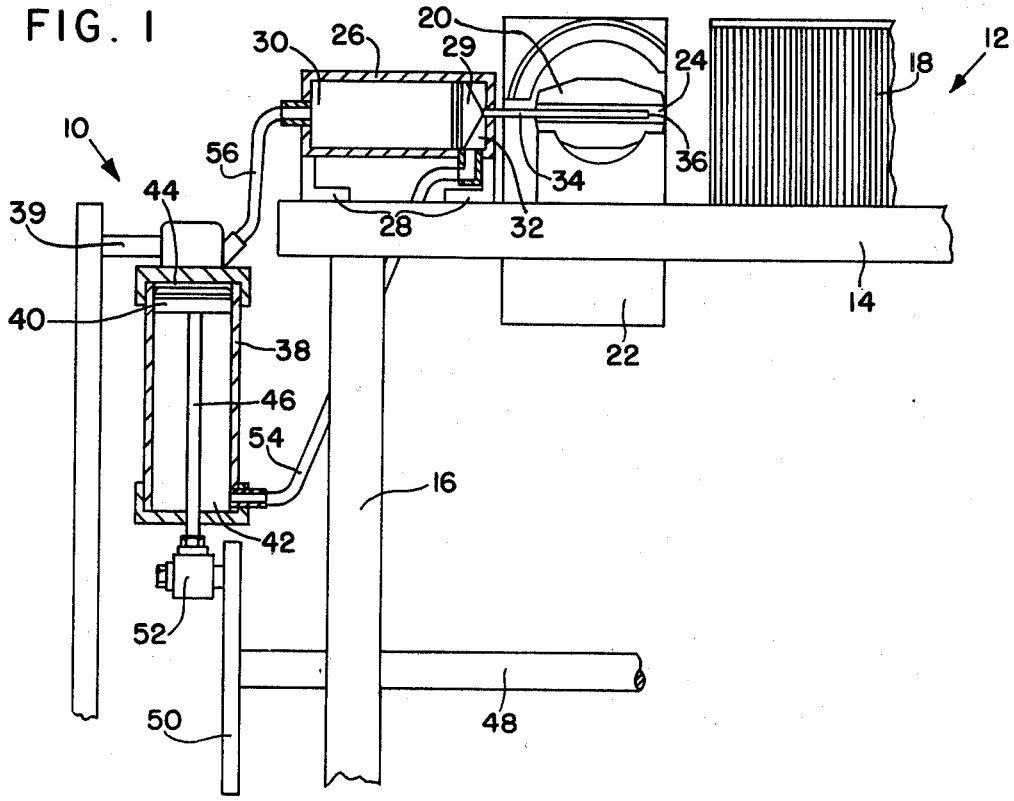
FIG. 1 is a diagrammatic view of the pneumatic picking system of the present invention showing the pump and picking pistons at the end of a picking stroke.
Figure 2:
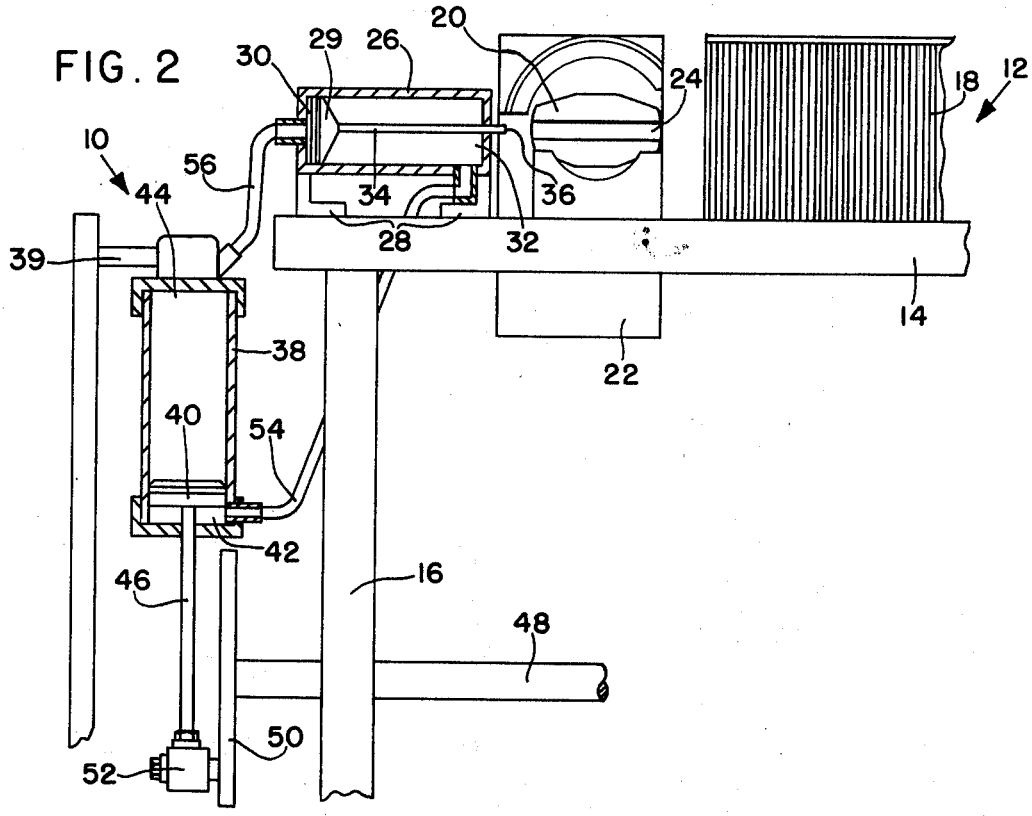
FIG. 2 is a view similar to FIG. 1 showing the picking and pump pistons at the end of their return strokes.

Referring particularly to FIGS. 1 and 2, the pneumatic picking mechanism of the present invention is generally indicated by the reference numeral 10 and is shown in these figures applied to a loom generally indicated by the reference numeral 12. Loom 12 includes a lay beam 14, mounted between a pair of lay swords 16, only one of which is shown, and a reed 18, mounted on the lay beam 14. Only the left hand end of the loom is shown in FIGS. 1 and 2, it being understood that the right hand end is identical and also includes a pneumatic picking mechanism 10 such as that shown in drawings. A shuttle box 20 is rotatably mounted on a bracket 22 which is fixed to the end of the lay beam 14. Shuttle box 20 contains a groove 24 for receiving a shuttle which is picked from the right hand side of the loom. Shuttle box 20 is the type which is rotated 180° after the shuttle is received into the groove 24 and is then rotated back 180° after the shuttle has been picked by the picking mechanism to be described. The type of loom to which the invention is applied is shown in more detail in the above-identified U.S. Pat. No. 3,330,305, but the invention is not necessarily limited to the type of loom shown as it can be applied to any loom which utilizes pneumatic picking.

Picking mechanism 10 comprises a picking cylinder 26 mounted on a bracket 28 fixed to the end of lay beam 14. Cylinder 26 contains a piston 29, slidable between an inlet end 30 and an outlet end 32 of the cylinder. A piston rod 34 is attached to piston 29 and extends through the outlet end 32 of cylinder 26 to a point adjacent the shuttle box 20. Movement of the piston 29 from the inlet end 30 to the outlet end 32 of the cylinder 26 causes the end 36 of the piston rod 34 to contact a shuttle located in the groove 24 of shuttle box 20. Picking mechanism 10 also includes a pump cylinder 38 pivotally mounted at 39 which contains a pump piston 40 slidable between the inlet end 42 and the outlet end 44 of the cylinder. A pump piston rod 46 is attached to piston 40 and extends through the inlet end 42 of the pump cylinder 38. A shaft 48 is driven from the main shaft of the loom in synchronized relation with the motion of the heddle frames, not shown, and with the reciprocating motion of reed 18. A crank 50 is attached to the outer end of shaft 48 and is attached to piston rod 46 through a connector 52 for reciprocating piston 40 within cylinder 38. A conduit 54 pneumatically connects the inlet end 42 of cylinder 38 to the outlet end 32 of picking cylinder 26. A conduit 56 pneumatically connects the outlet end 44 of pump cylinder 38 to the inlet end 30 of picking cylinder 26. Cylinders 26 and 38 are arranged in a closed system whereby air is transferred back and forth between the cylinders for each reciprocation of the pump piston 40.

At the beginning of a picking cycle, pistons 40 and 29 are located at the inlet ends of their respective cylinders, as shown in FIG. 2. Through the action of crank 50, piston 40 is driven from the inlet end 42 to the outlet end 44 of cylinder 38 and thereby compresses the air at the outlet end 44. This compressed air is transferred to the inlet end 30 of cylinder 26 through conduit 56. Latching means, not shown, hold piston 29 at the inlet end 30 until the appropriate time of picking, at which time the latching mechanism is released allowing piston 29 to travel from inlet end 30 to outlet end 32 of cylinder 26 so that the end 36 of piston rod 34 strikes the shuttle located within the groove 24 of shuttle box 20. This propells the shuttle out of the groove 24 and across the open shed to the opposite side of the loom, see FIG. 1. Air at the outlet end of picking cylinder 26 is displaced into the inlet end 42 of pump cylinder 38 through conduit 54. During the return stroke of pump rod 46, piston 40 moves from the outlet end 44 to the inlet end 42 of cylinder 38. Air in the inlet end 42 is compressed and displaced to the outlet end 32 of cylinder 26 through conduit 54. This forces picking piston 29 back from the outlet end 32 to the inlet end 30 of cylinder 26, as shown in FIG. 2. This motion pushes piston rod 34 to the left as viewed in FIG. 2 away from shuttle box 20 which is now free to turn 180° to the shuttle receiving position.

Figure 3:
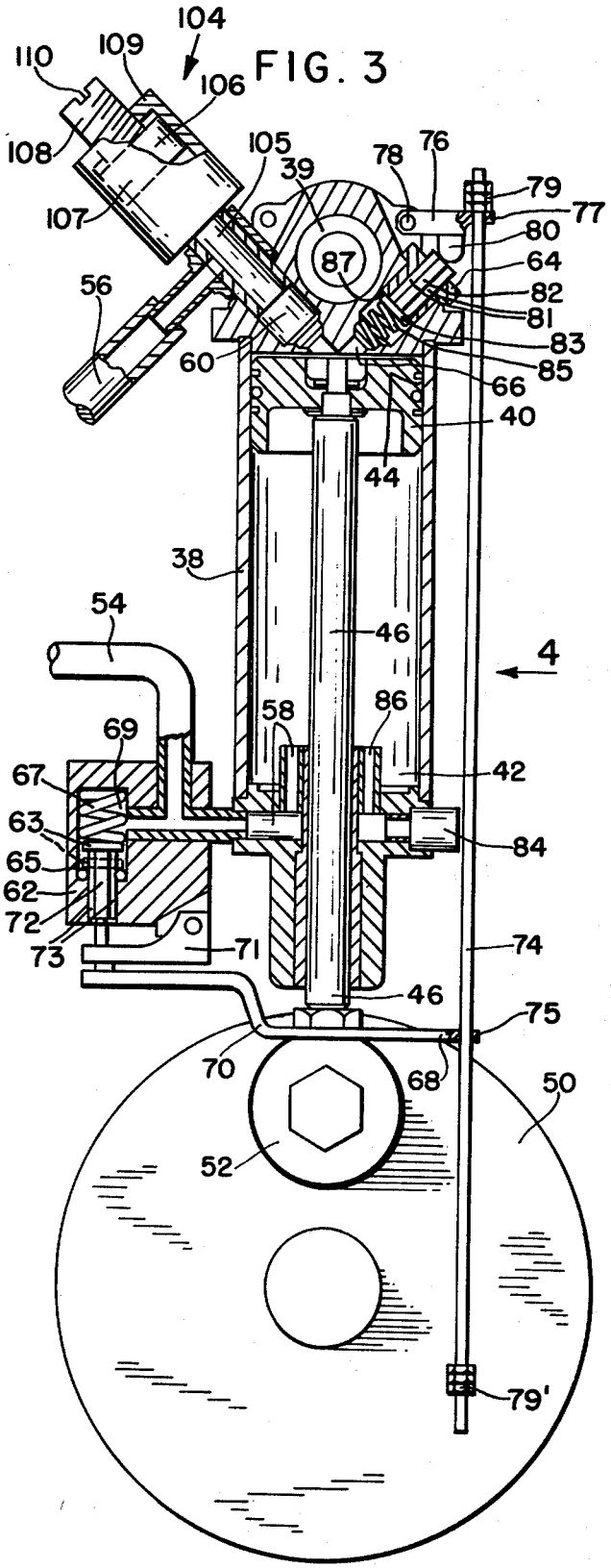
FIG. 3 is an enlarged detailed section of the pump cylinder with a one-way valve located adjacent the inlet end of the cylinder.

Referring particularly to FIG. 3, the pump cylinder 38 is shown in greater detail. Conduit 54 is pneumatically connected to the inlet end 42 of cylinder 38 through a passageway 58 and conduit 56 is connected to the outlet end 44 of cylinder 38 through a passageway 60. A first bleeder valve 62 is located within passageway 58 and a second bleeder valve 64 is located adjacent the outlet end 44 of the cylinder 38 and is pneumatically connected to the outlet end 44 by a passageway 66. Valves 62 and 64 are spring loaded plunger valves such as those used on automobile tires. This type of valve is normally closed and is opened upon depression of its plunger. Air will flow in the direction of lesser pressure when the valve is opened. Plunger 72 is slidably mounted in valve 62 and has a head 63 which is urged against a seat 65 by a spring 67 to maintain the valve 62 closed as shown in dotted lines in FIG. 3. Spring 67 is positioned within a cavity 69 which is interconnected to conduit 54 and passageway 58. A bracket 68 is fixed to connector 52 and has an upwardly extending portion 70 which is effective to engage and rock a lever 71 which is pivoted on valve 62 when connector 52 is in the upper position at the end of the working stroke of piston 40, as shown in FIG. 3. Rocking of lever 71 depresses plunger 72 and moves head 63 away from seat 65 as shown in full lines in FIG. 3. The cross section of plunger 72 is in the shape of a cross having spaces 73 which extend from the head 63 to the outside of the valve 62. These spaces enable air to pass from inlet 42 to the atmosphere via passageway 58 when the pressure in inlet end 42 is above atmospheric and enables air to enter inlet end 42 from the atmosphere when the pressure in inlet end 42 is below atmospheric. An upwardly extending rod 74 is slidably mounted in an opening 75 in bracket 68 and in an opening 77 in a lever 76. An upper stop 79 is fixed to the upper end of rod 74 above lever 76 and a lower stop 79' is fixed to the lower end of rod 74 below bracket 68. Lever 76 is pivotally attached at 78 to the upper end of cylinder 38 and has attached thereto a downwardly extending pressure pin 80. During the return stroke of piston 40, bracket 68 slides along rod 74 and strikes stop 79' and thereby moves rod 74 downwardly. This causes stop 79 to rock lever 76 clockwise as viewed in FIG. 3 around pivot 78. This motion of lever 76 causes pressure pin 80 to depress a plunger 82 of second bleeder valve 64. Plunger 82 has the same cross section as plunger 72 and has spaces 81 which extend from a head 83 to the atmosphere. A spring 85 urges head 83 against a seat 87 to maintain valve 64 normally closed as shown in FIG. 3. Depression of plunger 82 opens valve 64 and connects the outlet end 44 of cylinder 38 to the atmosphere. Air will flow into outlet end 44 from the atmosphere when the pressure in outlet end 44 is below atmospheric and from outlet end 44 to the atmosphere when the pressure within outlet end 44 is above atmospheric.

Figure 4:
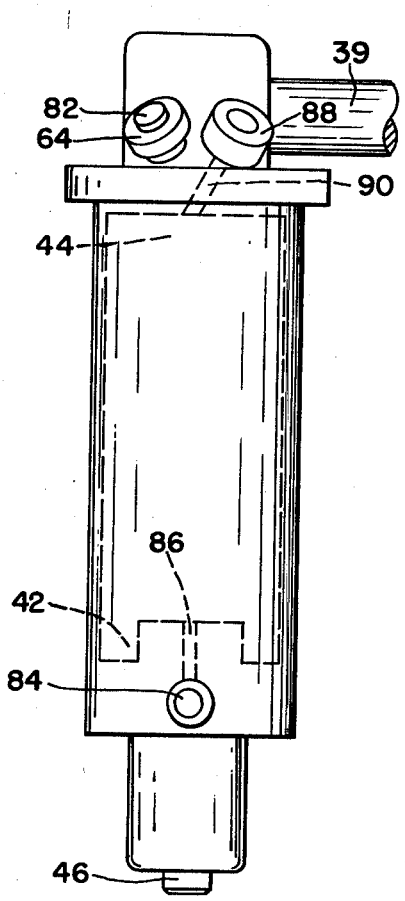
FIG. 4 is an elevation of the pump cylinder showing a one-way valve at the inlet and outlet ends of the pump cylinder.

Located adjacent the inlet end 42 of cylinder 38 is a first one-way valve 84 which is effective to connect the inlet end 42 to the atmosphere by a passageway 86 whenever the pressure within the inlet end 42 falls below atmospheric pressure. A second one-way valve 88 is located adjacent the outlet end 44. Second one-way valve 88 is effective to pneumatically connect outlet end 44 to the atmosphere via a passageway 90 whenever the atmospheric pressure within the outlet end 44 falls below that of atmospheric pressure, see particularly FIGS. 4 and 5.

Figure 5:
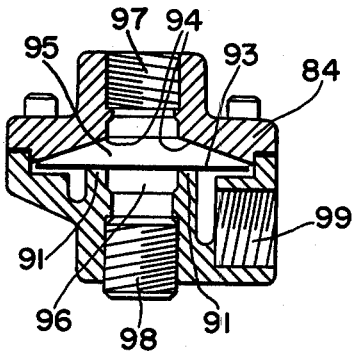
FIG. 5 is a detailed section of one of the one-way valves.

Referring particularly to FIG. 5, valve 84 is shown in greater detail. Valve 88 is not illustrated in detail since it is identical to valve 84. Valve 84 includes an elastomeric diaphragm 93 loosely positioned in a chamber 95 within the valve. An inlet passage 97 is connected to a first portion of chamber 95 and an outlet passage 99 is connected to a second portion of chamber 95. The loosely positioned diaphragm 93 extends between passages 97 and 99 but does not prevent air from flowing from passage 97 to passage 99. When air flows in this direction the center of diaphragm 93 is forced against a central supporting structure 91 and air is allowed to flow around the edges of the diaphragm. When air flows from passage 99 to passage 97, diaphragm 93 is forced against a generally concave surface 94 so as to seal inlet passage 97. Therefore diaphragm 93 allows air to enter cylinder 38 when the pressure in the cylinder falls below atmospheric but air is prevented from flowing out of cylinder 38 to the atmosphere when the pressure within the cylinder is above atmospheric. Valve 84 has a third passage 96 which is not used in this particular application and is therefore sealed with a plug 98. Valves of this type may be purchased from Schrader Fluid Power Division of Scovill and located at Wake Forest, N.C. The valve is identified as a "quick exhaust valve" in the Schrader Catalogue VAL-1 Rev. 3/74.

Once that the pressures within cylinders 26 and 38 have reached their ideal operating state, the loom continues to run normally. Any variations in air pressure within either of the cylinders from the ideal pressure state will be corrected by the bleeder valves 62 and 64 as the variations occur. This will be true even if the pressures are above the ideal as a result of heating or below the ideal due to loss of air from the system. Since the variations are corrected during every cycle, they will be small and can be taken care of very adequately by the bleeder valves. If for any reason the loom is shut down for an extended period of time between shifts or for changing a warp, there is a tendency for air to be lost from the picking system through the various seals. When the loom is again started, the pressures may be so far from the ideal that they cannot be corrected by the bleeder valves for several picks. If the loom is started when the pistons 40 and 29 are in the position shown in FIG. 2, the first working stroke of piston 40 will cause piston 29 to be shifted from the inlet end 30 to the outlet end 32 of cylinder 26. Since the pressures in the beginning are inadequate this will result in a weak pick. However, during this power stroke, one-way valve 84 allows air to enter the inlet end of cylinder 38 from the atmosphere so that during the return stroke of piston 40 the pressure within the inlet end of cylinder 38 will be great enough when transmitted to the outlet end 32 of cylinder 26 to force piston 29 all the way back to the inlet end 30 of cylinder 26 and thereby fully retract the picking piston rod 34. This is particularly crucial when the invention is applied to the type of loom in which the shuttle box rotates 180°. During this return stroke of piston 40 one-way valve 88 allows air to enter the outlet end 44 of cylinder 38 to build the pressure in that portion of the cylinder back to the ideal condition. On the next working stroke of piston 40, there will be sufficient pressure in outlet end 44 so that the air which is forced from this outlet end to the inlet end 30 of cylinder 26 will force piston 29 to the outlet end 32 to a sufficient degree to enable piston rod 44 to pick the shuttle completely across the open warp shed to the opposite side of the loom. After the initial picking cycle, the pressures on both sides of the closed system in the pneumatic picking mechanism 10 will be sufficiently high to enable the loom to operate satisfactorily. Thereafter, any small variations in pressures will be taken care of by the bleeder valves 62 and 64.

Referring to FIG. 3, a power dome generally indicated at 104, is located at the end of a branch portion 105 of passageway 60. Power dome 104 includes a piston 106 slidably mounted in a cylinder 107. Piston 106 has a reduced portion 108 which is threaded into the outer wall 109 of cylinder 107 and includes a slot 110 in its outer end. Reduced portion 108 is rotated by engaging slot 110 with a screwdriver. Movement of piston 106 within cylinder 107 either increases or decreases the pressure in the outlet end 44 of pump cylinder 38. Therefore the pressure in cylinder 38 can be easily adjusted by the operator to a desired pressure or to change the pressure within the cylinder for different weaving conditions.

I claim:

1. A pneumatic shuttle picking mechanism for looms comprising:

(a) a picking cylinder having an inlet end and an outlet end;

(b) a piston slidable within said picking cylinder between said inlet and outlet ends;

(c) a piston rod attached to said piston and which extends through said outlet end for picking engagement with a shuttle;

(d) a pump cylinder having an inlet end and an outlet end;

(e) a pump piston slidable within said pump cylinder between the inlet and outlet ends of said pump cylinder;

(f) a pump piston rod attached to said pump piston and which extends through the inlet end of said pump cylinder;

(g) drive means connected to the extending portion of said pump piston rod for reciprocating said pump piston rod and said pump piston;

(h) a first conduit for pneumatically connecting the inlet end of said picking cylinder to the outlet end of said pump cylinder;

(i) a second conduit for pneumatically connecting the outlet end of said picking cylinder to the inlet end of said pump cylinder; and (j) a one-way valve located at one end of said pump cylinder which allows air to enter said pump cylinder from the atmosphere when the pressure within the cylinder at said one end falls below atmospheric pressure.

2. A pneumatic shuttle picking mechanism as set forth in claim 1 wherein there is a one-way valve at each end of said pump cylinder.

3. A pneumatic shuttle picking mechanism as set forth in claim 1 comprising:

(a) a normally closed bleeder valve located at one end of said pump cylinder which is effective when opened to allow air to enter said pump cylinder at said one end when the air pressure within said pump cylinder at said one end is below atmospheric pressure and to allow air to exit from said pump cylinder at said one end when air pressure within said pump cylinder at said one end is above atmospheric pressure; and (b) actuating means for opening said bleeder valve for a predetermined time period during each reciprocation of said second piston.

4. A pneumatic shuttle mechanism as set forth in claim 3 wherein there is a bleeder valve located at both ends of said pump cylinder.

* * * * *